United States Patent [19]

McNeill

[11] Patent Number: 4,902,005

[45] Date of Patent: Feb. 20, 1990

[54] WATER RESISTANCE TYPE EXERCISE MACHINE FOR ARMS

[76] Inventor: Michael R. McNeill, 2 Circle Dr., Hawthorn Woods, Ill. 60047

[21] Appl. No.: 279,025

[22] Filed: Dec. 2, 1988

[51] Int. Cl.[4] ..... A63B 21/00

[52] U.S. Cl. ..... 272/116

[58] Field of Search ..... 272/116, 71, 93; 441/56, 58, 59; 424/254

[56] References Cited

U.S. PATENT DOCUMENTS

| | | | |
|---|---|---|---|
| 2,850,748 | 9/1958 | Read | 272/71 |
| 3,424,133 | 1/1969 | Brady | 272/116 |
| 4,300,759 | 11/1981 | Caplan | 272/116 |
| 4,480,829 | 11/1984 | Yacoboski | 272/116 |
| 4,521,011 | 6/1985 | Solloway | 272/116 |
| 4,623,142 | 11/1986 | MacKechnie | 272/116 |
| 4,627,613 | 12/1986 | Solloway | 272/116 |
| 4,632,387 | 12/1986 | Guzman | 272/116 |
| 4,819,951 | 4/1989 | Solloway | 272/116 |

*Primary Examiner*—Richard J. Apley
*Assistant Examiner*—J. Welsh
*Attorney, Agent, or Firm*—Charles F. Meroni, Jr.

[57] ABSTRACT

A water exercise device for use under water including a main body comprised of a light weight synthetic plastic. The body has a fan-shaped intermediate body section. A pair of tubular sections are provided at opposite margins of the fan-shaped body section. The tubular sections are provided with inner and outer open ends and with the tubular sections being of such diameter for receiving hands and forearms of a person when extended through the inner ends of the tubular sections. Rotary turnable hand grips are disposed in each of said tubular sections generally at the outer ends thereof. The hand grips are held in the tubular sections to limit axial movement of the hand grips while allowing the hand grips to be freely rotated therein when the arms are extended through the inner ends into the tubular section and then into contact with the hand grips.

21 Claims, 4 Drawing Sheets

FIG. 1
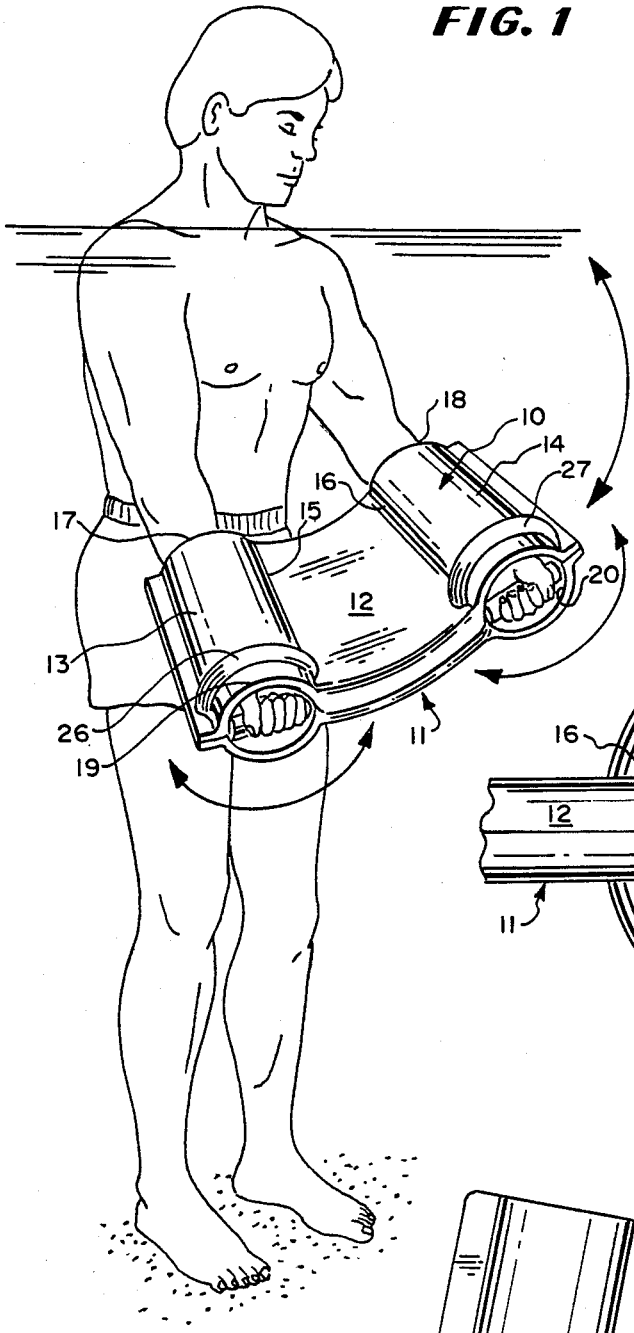
FIG 3
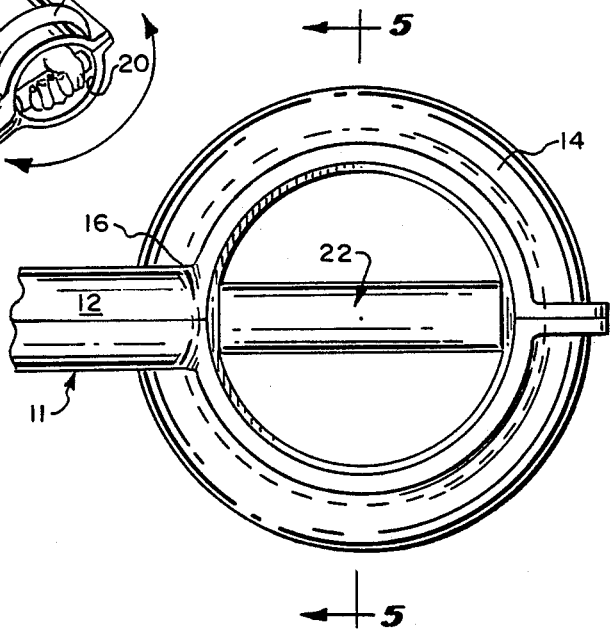
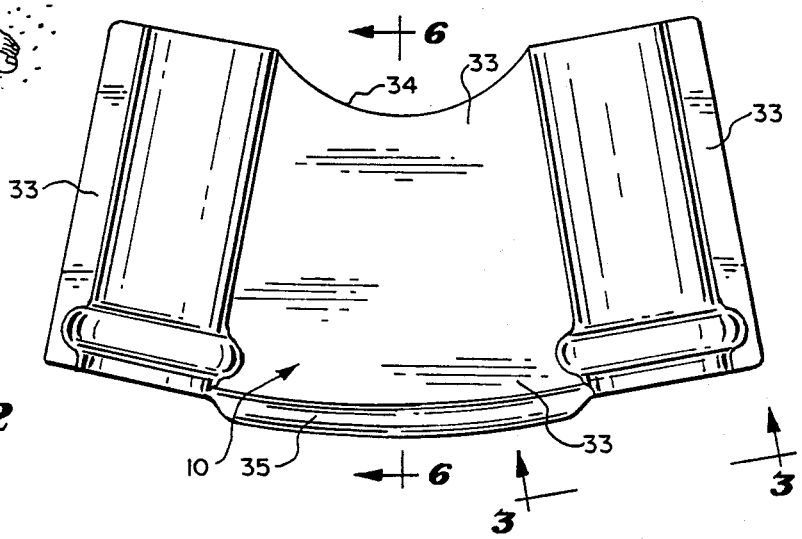
FIG. 2

FIG. 7
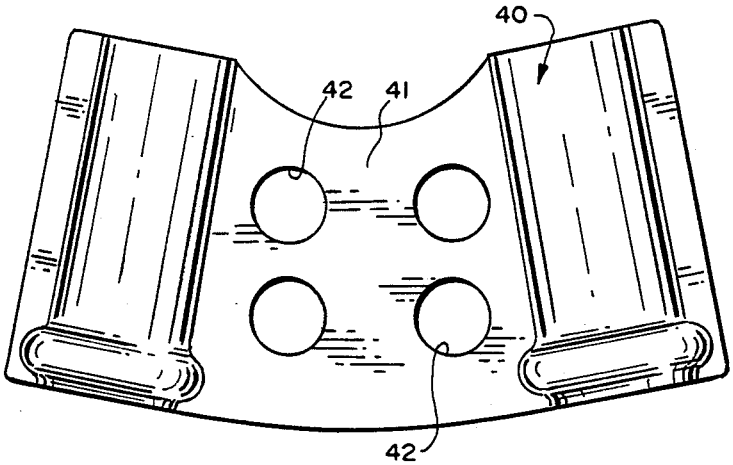
FIG. 8
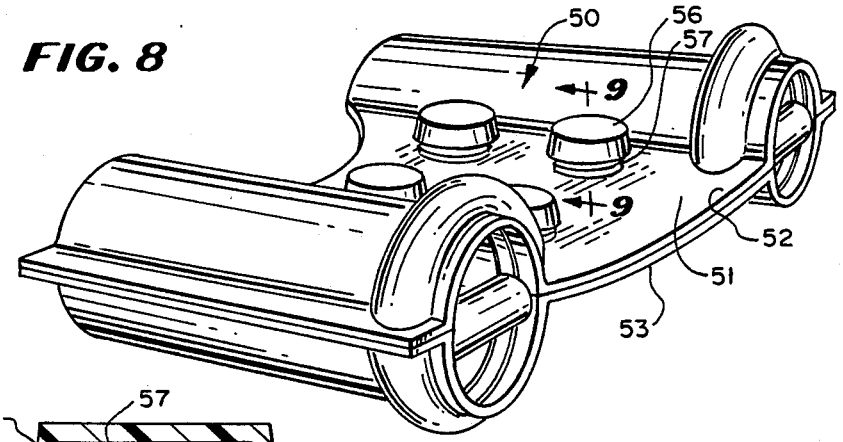
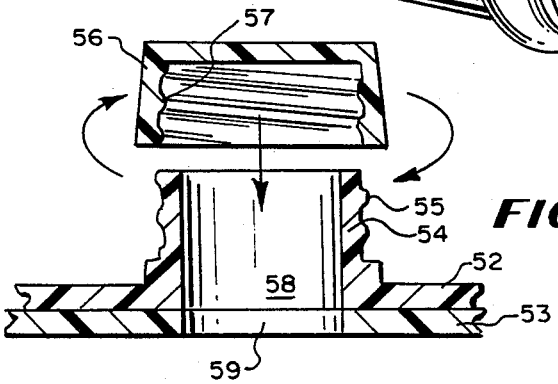
FIG. 9
FIG. 10
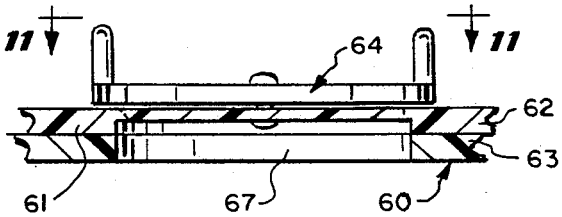
FIG. 11
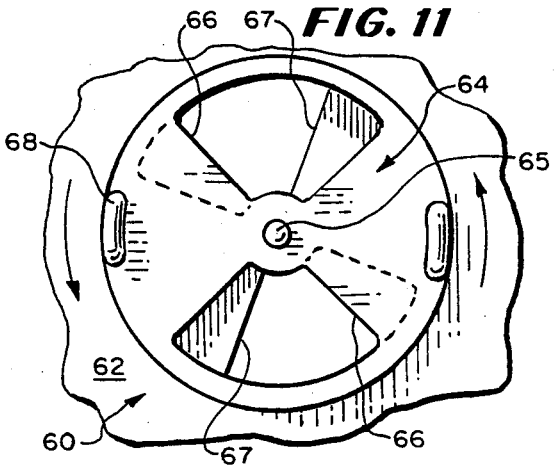

WATER RESISTANCE TYPE EXERCISE MACHINE FOR ARMS

BACKGROUND OF THE INVENTION

The present invention is concerned with a new and improved water resistance type exercise machine or device for arm and upper body exercises. The device I have invented is most suitably used by a person when that person is submerged in water with the water level being at neck level so that a person can raise and lower the device by moving his or her arms up and down while holding his or her elbows next to the person's waist with the device being submerged in the water. The motion is the same as the standard curl movement used in free weight training. The only difference is that the hands can rotate to match the arm movements. On the downward movement, the hands rotate so that the palms face down. During this downward movement the triceps are exercised. On the upward movement the hands rotate so that the palms face up. During this upward movement the biceps are exercised. When the device is being used, both arms are telescoped into the device in such a way that the hands are engaged with hand grips to hold the device in a desired position relative to the arms of the person using it. By using my exercise machine or device, it is possible to exercise a person's biceps, triceps and forearms. As the device is moved in the water from its lower most position to its upper most position, the device can be moved for brief periods out of the water.

My water exercise device includes an intermediate body section which is preferably of a fan-shaped configuration. The intermediate body section has a pair of tubular sections at opposite margins thereof. These tubular sections have a diameter that exceeds the size of a person's hands and forearms so that the hands and forearms can be readily extended into the tubular sections from inner ends of the tubular sections to grasp hand grips which are disposed generally at outer ends of the tubular sections. Most desirably, the water exercise device is comprised of a pair of molded sheets of a suitable synthetic plastic such as polyethylene type of plastic with outer margins being secured in heat sealed assembly.

The intermediate body section of my water exercise device can be provided with ports to allow water to freely flow there through in a controlled manner. These ports can be provided with various types of regulating means to control the amount of water flow through the ports as will be apparent from a more detailed consideration of my patent disclosure. Water resistance can be regulated by opening or closing adjustable vent holes, which, in turn, lessens or increases the work done by the appropriate muscles.

It is my belief that my new and improved water exercise device can be used in such a way to enable the user to exercise the user's arms and upper body in such a way that both arms can be simultaneously exercised as contrasted to devices that are known to me as hereafter described.

It is a further important object of mine to provide a new and improved light weight water exercise device that can be quickly and economically manufactured on a production basis and which can be readily cleaned and maintained by the user.

DESCRIPTION OF THE PRIOR ART

Heretofore, various water exercise devices have been used for exercising the upper body and legs of a person. Typical devices that have come to my attention as a result of my review of the state of the art are illustrated in the following listed U.S. Patents:

| U.S. Pat. No. | Patentee | Date of Issue |
|---|---|---|
| 2,850,748 | R. L. Read | 9/5/58 |
| 4,411,422 | Daniel S. Solloway | 10/25/83 |
| 4,521,011 | Daniel S. Solloway | 6/4/85 |
| 4,627,613 | Daniel S. Solloway | 12/9/86 |
| 4,632,387 | Horacio J. Guzman | 12/30/86 |
| 4,685,667 | Malcolm C. McDonald | 8/11/87 |

It is not believed that any of the above listed patents are anticipatory of my invention, and further discussion of them here is not believed to be warranted.

SUMMARY OF THE INVENTION

According to important features of my invention I have provided a water exercise device for use under water including a main body comprised of a light weight synthetic plastic, the body having a fan-shaped intermediate body section, a pair of tubular sections at opposite margins of the fan-shaped body section, the tubular sections having inner and outer open ends and with the tubular sections being of such diameter for receiving hands and forearms of a person when extended through the inner ends of the tubular sections, rotary turnable hand grips disposed in each of said tubular sections generally at the outer ends thereof, and means connected to the tubular sections limiting axial movement of the hand grips while allowing the hand grips to be freely rotated therein when the arms are extended through the inner ends into the tubular sections and then into contact with the hand grips.

According to still other features of my invention the body is comprised of two molded sheets of the synthetic plastic with outer margins thereof secured in heat sealed assembly.

Yet other features of my invention concerns the fan-shaped web section being provided with a plurality of openings so that the water can freely flow through the openings thus provided in the fan-shaped intermediate body section when used in water during an exercise procedure.

Still other features of my invention relate to the water exercise device being provided with transversely spaced annular ribs with one of the ribs being positioned on each of the tubular sections, the ribs each defining a radially inwardly opening annular groove, and with each of the rotary hand grips having an annular outer margin in nested engagement inside of the associated radially inwardly opening annular groove thus locking the associated hand grip against axial movement in the associated tubular section while permitting the hand grip to freely rotate rotate within the tubular section as it is being turned by the person using the device.

Yet further features of my invention relate to a water exercise device for use under water including a main body comprised of a light weight synthetic plastic, the body having a fan-shaped intermediate body section, a pair of tubular sections at opposite margins of the fan-shaped body section, the tubular sections having diverging axes that are closer at inner ends of the body, the tubular sections having inner and outer open ends and with the tubular sections being of such diameter for receiving hands and forearms of a person when extended through the inner ends of the tubular sections, and hand grips disposed in each of said tubular sections generally at the outer ends thereof, the hand grips being grasped when the arms are extended through the inner ends into the tubular sections and then into contact with the hand grips.

According to other features of my invention, I have provided a fan-shaped intermediate body section which has spaced ports for permitting water to flow there through in a controlled manner.

Yet other features of my invention concern the fan-shaped intermediate body section also having port closing means of various types for closing and/or regulating the amount of water flowable through the ports as the device is being used by the user.

Still other features concern the provision of threaded nozzles on the fan-shaped intermediate body section and with caps being mounted and threaded in engagement with the nozzles to act as closures to prohibit water flow there through.

Still another feature concerns the use of a different type of port closure means where a rotary plate has spaced holes in it. The rotary plate is secured by a rotary connection to the intermediate fan portion and the spaced holes in the rotary plate can be aligned with the spaced ports so that a regulated water flow can be permitted through the intermediate body section as the user exercises in a water bath.

BRIEF DESCRIPTION OF THE DRAWINGS

Further features, objects and advantages of the invention will be found throughout the following more detailed description which refers to the accompanying drawings, disclosing several embodiments, wherein:

FIG. 1 is a perspective view of my water exercise device illustrating the way that it can be used in a water bath;

FIG. 2 is a plan view of the water exercise device shown in FIG. 1;

FIG. 3 is an enlarged fragmentary end view of my water exercise device as seen represented by the lines 3—3 looking in the direction indicated by the arrows as seen in FIG. 2;

FIG. 7 is a top plan view of a modified water exercise device similar to FIG. 2 only with ports being provided;

FIG. 8 is a perspective view of still another modified type of my water exercise device with port closures;

FIG. 9 is an enlarged fragmentary vertical section taken on the line 9—9 looking in the direction indicated by the arrows as seen in FIG. 8 and with the closure cap being shown in a detached position;

FIG. 10 is an enlarged partially fragmentary section view of still another modified type of a port closure for water ports in an intermediate body section of my water exercise device;

FIG. 11 is an enlarged fragmentary plan view of the water exercise device shown in FIG. 10 as viewed on the line 11—11 looking in the direction indicated by the arrow;

DESCRIPTION OF THE PREFERRED EMBODIMENTS

Figure 4:
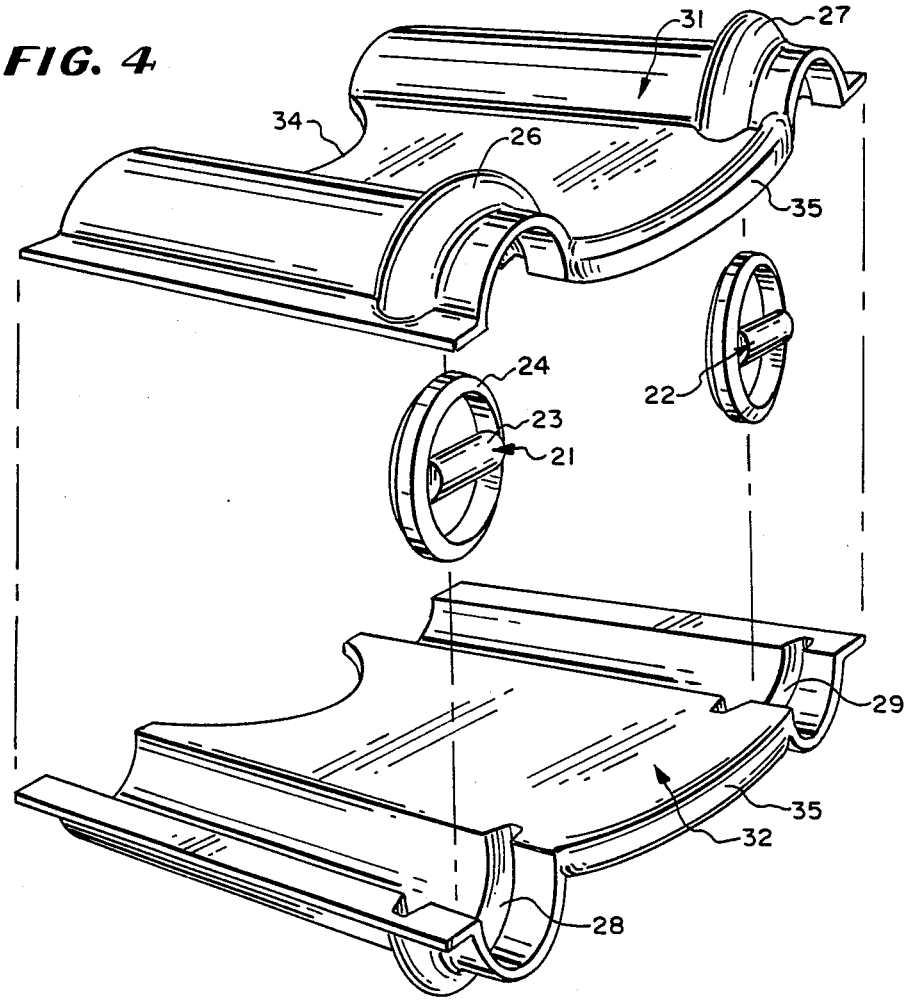
FIG. 4 is an enlarged exploded view of my water exercise device.

According to my invention the reference numeral 10 indicates generally my water exercise device for use by a person under water. The device 10 further includes a main body 11 that is comprised of a light weight synthetic plastic. The body 11 has a fan-shaped intermediate body section 12. A pair of tubular sections 13 and 14 are integrally attached or formed with the body section 12 at opposite margins 15 and 16 of the body section. The tubular sections 13 and 14 are provided with an inner open ends 17, 18 and an outer open ends 19, 20. The tubular sections are such of diameter so as to be sufficiently large to permit an adult person to telescope hands and forearms into the inner open ends.

Figure 5:
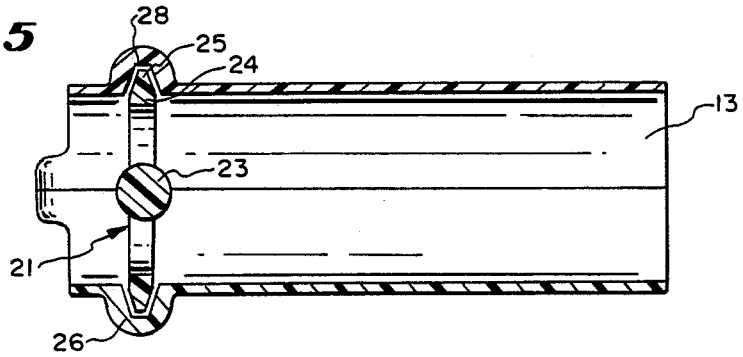
FIG. 5 is an enlarged vertical section taken on a line 5—5 looking in the direction indicated by the arrows as seen in FIG. 3.
Figure 6:
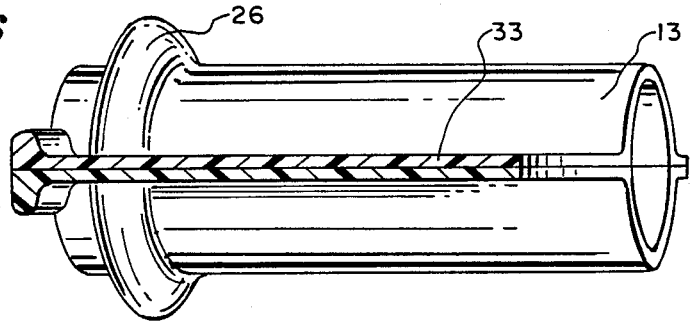
FIG. 6 is an enlarged perspective view partially in section of one of the tubular sections provided on my water exercise device.

Mounted within the tubular sections 13 and 14 are a pair of handle structures 21 and 22. These handle structures 21 and 22 each include a handle 23 and an outer circular mounting ring formed integral with the handle 23. The mounting ring 24 also has a radially outwardly extending annular margin or truncated nose portion 25, 25 (FIGS. 4 and 5).

The tubular sections 13 and 14 are each provided with radially outwardly extending tube section ribs 26 and 27. These ribs 26 and 27 define radially inwardly opening annular grooves for seats for the annular margin or nose portions 25, 25 on the handle structures or hand grip structures 21 and 22.

It is contemplated by me that my water resistance exercise machine or device is to be made of rigid materials that are not highly buoyant. Suitable synthetic plastics are available for this purpose. It is further contemplated that my exercise machine or device 10 is to be molded and formed with upper and lower body halves 31 and 32. After the halves 31 and 32 have been molded they are to be heat sealed at the margins of the halves as indicated generally at 33 so that all seams between the halves are water tight.

In order to facilitate use of my machine 10, I have provided an inner contoured surface 34 which follows the curvature of a person's mid section so that the device can be raised and lowered by the arms and the hands together with the elbows next to the waist.

Another way to enhance the water resistance of my exercise machine, I have provided an arcuately shaped reinforcing water impeding rib 35 at an outer edge of the intermediate section of my water exercise machine or device as indicated at 35. As the exercise machine or device is elevated this rib 35 will serve to provide a greater surface area of resistance to the upward movement of the device in the water thus requiring the person to exert more effort to move the device in the water.

Shown in FIG. 7 is a modified water exercise device or machine 40. This device is identical to the one shown in the earlier figures for the most part but has the added feature of the device having a fan-shaped intermediate body section 41 provided with a series of spaced ports or openings 42 to enable water to freely flow through the intermediate body section 41 as the device 40 is moved up and down in the water.

In FIGS. 8 and 9 I have provided a further modification where my water exercise device 50 has its fan-shaped intermediate body section 51 provided with upper and lower halves 52 and 53. The upper half has a series of collars 54. Each of the collars 54 is provided with threads 55. Cooperable with each of the collars 54 are closure caps 56. The caps 56 have inside threads 57 that are adapted to be matched with the threads 55 in threaded assembly therewith. Thus, the caps 56 can be readily secured and unsecured with the threads 55 on the collars 54 to adjust the amount of resistance that a person may desire while engaged in an exercise activity using my water exercise device 50.

Shown in FIGS. 10 and 11 is yet another modification of my device and in this instance the device is indicated generally at 60. The device 60 also has a fan-shaped intermediate body section 61 and this section is comprised of upper and lower halves 62 and 63. Mounted on the upper half 62 is a rotary plate valve member 64. To this end, a fastener 65 is provided for securing the rotary plate valve member 64 to the upper half 62 or to the intermediate body section 61. The rotary plate valve member is preferably of a circular shape and has a pair of wedge shaped ports 66, 66 on opposite sides of a central axis of the circular valve member 64 or on opposite sides of the fastener 65. These ports are cooperable with openings 67, 67 provided in the upper half 62 or the intermediate body section 61. The valve member 64 can be made of any suitable material such as a synthetic plastic and embossments or handles 68 can be formed in an outside face of the valve member 64 to enable the person to use the embossments to manually move the valve member 64 to a preselected position. In the operation of my device 61 shown in FIGS. 10 and 11, the valve member 64 can be rotated to open the spaced ports to allow a controlled amount of water to flow through the intermediate body section 61 and through the space ports 66, 66 in the rotary plate valve member 64 and through the holes in the intermediate body section when the holes and the ports are in alignment. The rotary plate valve member 64 further acts as a closure to cut off water flow when the holes 67, 67 and the port 66, 66 are misaligned.

Figure 12:
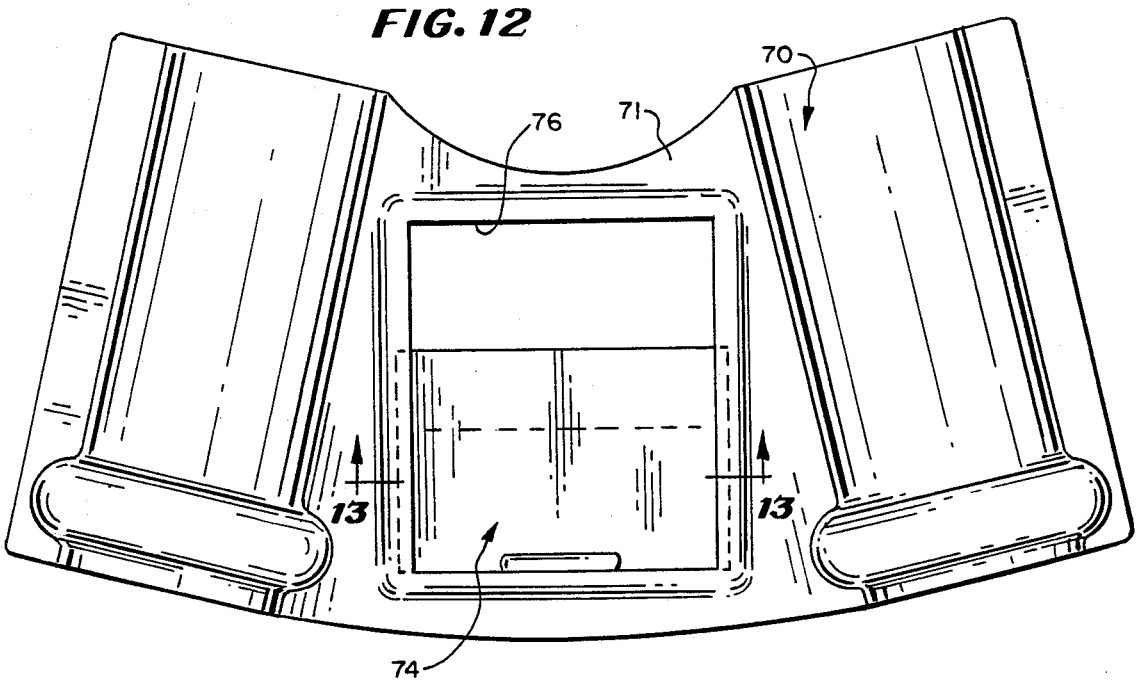
FIG. 12 is a plan view of yet another modified type of water exercise device.
Figure 13:
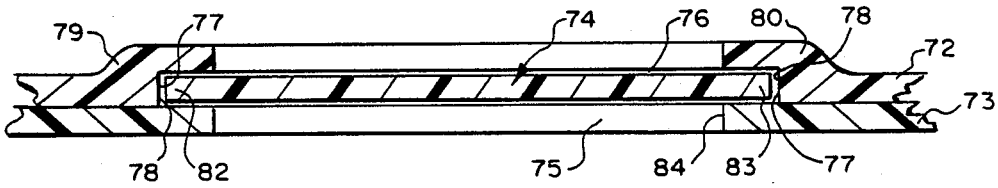
FIG. 13 is an enlarged fragmentary vertical section taken on the line 13—13 looking in the direction indicated by the arrows as seen in FIG. 12.

Shown in FIGS. 12 and 13 is yet another modified water exercise device or machine 70. Once again the machine 70 has a fan-shaped intermediate body section 71. The machine or device 70 including the intermediate body section 71 are formed as separate halves 72 and 73 as previously described. In this instance, however, the intermediate section 71 has a parallel edged manually slidable closure plate 74. This plate is mounted on the fan-shaped intermediate body section 71 so as to enable the closure plate 74 to be moved over an opening 75 in the lower half 73 of the intermediate body section 71 as shown in FIG. 13. The upper half 72 has an upper port 76 so that when the manually slidable closure plate 74 is in its open position, water can flow through the opening 75 and the port 76. The water flow can be controlled depending on the position of the plate 74 relative to the port 76 so that if the manually slidable closure plate 74 is left in a partially open position, then a reduced amount of water can be allowed to flow through the port 76 as the exercise device 70 is moved in the water by the person using it.

For the purpose of mounting the manually slidable closure plate 74 on the intermediate section 71, the upper half 72 is provided with stepped shaped surfaces 77, 77 which cooperate with the underlapping lower half 73 to provide transversely spaced mounting slots 78, 78 at opposite edges of the port 76. The underlapping lower half lies beneath the closure pate 74 to h old it in the slots 78, 78. To allow for the upper half 72 to be provided with enough synthetic plastic material at the areas of the stepped edges 77, 77, the intermediate body section 71 has raised bosses 79–80 on opposite sides of the port 76.

The manually slidable closure plate 74 has outer margins 82 and 83 which are engaged in the mounting slots or recesses 78, 78 as is also shown in FIG. 13. The opening 75 provided in the lower half 73 is defined by underlapping edges 84, 84 which underlap the closure plate 74 to assist in holding the closure plate 74 in the mounting slots or recesses 78, 78.

The operation of each of the modified forms shown in FIGS. 7–13 is essentially the same as the operation of the water exercise device shown in FIGS. 1–6.

It is thus seen, therefore, that there is provided an improved article and combination in which the objects of the invention are achieved and which are well adapted to meet all conditions of practical use.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A water exercise device for use under water including a main body comprised of a light weight synthetic plastic, the body having a fan-shaped intermediate body section, a pair of tubular sections at opposite margins of the fan-shaped body section, the tubular sections having diverging axes that are closer at inner ends of the body, the tubular sections having inner and outer open ends and with the tubular sections being of such diameter for receiving hands and forearms of a person when extended through the inner ends of the tubular sections, and hand grips held in each of said tubular sections generally at the outer ends thereof, the hand grips being grasped when the arms are extended through the inner ends into the tubular sections and then into contact with the hand grips.

2. The device of claim 1 further characterized by means between said hand grips and said tubular sections permitting rotary movement of the hand grips.

3. The device of claim 1 further characterized by the body being comprised of two molded sheets of the synthetic plastic with outer margins thereof secured in heat sealed assembly.

4. The device of claim 1 further characterized by the fan-shaped web section having a plurality of openings so that the water can freely flow through the openings thus provided in the fan-shaped intermediate body section when used in water during an exercise procedure.

5. The device of claim 1 further characterized by the main body having an enlarged upwardly protruding rib extending transversely of the body across the fan-shaped intermediate body section at its outer end for providing resistance to the person wearing the device as the person moves the device up and down when the device is submerged in water.

6. The device of claim 1 further characterized by the fan-shaped intermediate body section having spaced ports for permitting water to flow there through in a controlled manner.

7. The device of claim 1 further characterized by the fan-shaped intermediate body section having spaced ports, and port closure means cooperable with said ports for closing said ports when desired.

8. The device of claim 20 further characterized by fan-shaped body section having a contoured curved inner edge on the halves enabling a person's mid section to be received in the contoured curved inner edge.

9. A water exercise device for use under water including a main body comprised of a light weight synthetic plastic, the body having a fan-shaped intermediate body section, a pair of tubular sections at opposite margins of the fan-shaped body section, the tubular sections having inner and outer open ends and with the tubular sections being of such diameter for receiving hands and forearms of a person when extended through the inner ends of the tubular sections, rotary turnable hand grips disposed in each of said tubular sections generally at the outer ends thereof, and means connected to the tubular sections limiting axial movement of the hand grips while allowing the hand grips to be freely rotated therein when the arms are extended through the inner ends into the tubular sections and then into contact with the hand grips.

10. The device of claim 9 further characterized by the body being comprised of two molded sheets of the synthetic plastic with outer margins thereof secured in heat sealed assembly.

11. The device of claim 9 further characterized by the fan-shaped web section having a plurality of openings so that the water can freely flow through the openings thus provided in the fan-shaped intermediate body section when used in water during an exercise procedure.

12. The device of claim 9 further characterized by the main body having an enlarged upwardly protruding rib extending transversely of the body across the fan-shaped intermediate body section at its outer end for providing resistance to the person wearing the device as the person moves the device up and down when the device is submerged in water.

13. The device of claim 9 further characterized by said means comprising transversely spaced annular ribs with one of the ribs being positioned on each of said tubular sections, the ribs each defining a radially inwardly opening annular groove, and with each of said rotary hand grips having an annular outer margin in nested engagement inside of the associated radially inwardly opening annular groove thus locking the associated hand grip against axial movement in the associated tubular section while permitting the hand grip to freely rotate rotate within the tubular section as it is being turned by the person using the device.

14. The device of claim 9 further characterized by the fan-shaped intermediate body section having spaced ports for permitting water to flow there through in a controlled manner.

15. The device of claim 9 further characterized by the fan-shaped intermediate body section having spaced ports, and port closure means cooperable with said ports for closing said ports when desired.

16. The device of claim 15 further characterized by said means comprising with threaded nozzles extending from said fan-shaped intermediate body section, and caps mounted in threaded engagement with said threaded nozzles.

17. The device of claim 15 further characterized by said port closure means comprising a rotary plate valve member having spaced holes therein, said rotary plate valve member has a rotary connection permitting the rotary plate valve member to be rotated to open the spaced ports to allow a controlled amount of water to flow through the intermediate body section and through the spaced ports in the rotary plate valve member and through the ports in the intermediate body section when the holes and the ports are in alignment, the rotary plate valve member acting as a closure to cut off water flow when the holes and the ports are misaligned.

18. The device of claim 9 further characterized by said fan-shaped intermediate body section having at least one port therein, a manually slidable closure plate, and means connected to the intermediate body section mounting the closure plate on said intermediate body section so that the plate can move in a direction parallel to said tubular sections to open and shut off water flow through said at least one port.

19. The device of claim 9 further characterized by said body including the fan-shaped intermediate body section and said tubular sections being comprised of a pair of molded halves, said halves being secured in heat sealed assembly together.

20. A water exercise device for use under water including a main body comprised of a pair of light weight synthetic plastic halves, the body having an intermediate body section, a pair of tubular sections at opposite margins of the body section, the tubular sections having diverging axes that are closer at inner ends of the body, the tubular sections having inner and outer open ends and with the tubular sections being of such diameter for receiving hands and forearms of a person when extended through the inner ends of the tubular sections, hand grips disposed in each of said tubular sections generally at the outer ends thereof, and means securing the halves in stacked assembly together with said hand grips held inside of the tubular sections between the halves, the hand grips being grasped when the arms are extended through the inner ends into the tubular sections and then into contact with the hand grips.

21. The device of claim 20 further characterized by means between said hand grips and said tubular sections permitting rotary movement of the hand grips.

* * * * *